US009803874B2

(12) United States Patent
Sprenger Lobo

(10) Patent No.: US 9,803,874 B2
(45) Date of Patent: Oct. 31, 2017

(54) TRACTION BEARING AND ROD JOINT FROM THE SLIDING SHELF SET

(71) Applicant: Electrolux do Brasil S.A., Curitiba, Paraná (BR)

(72) Inventor: Orlando H. T. Sprenger Lobo, Curitiba (BR)

(73) Assignee: Electrolux do Brasil S.A., Curitiba (BR)

( * ) Notice: Subject to any disclaimer, the term of this patent is extended or adjusted under 35 U.S.C. 154(b) by 565 days.

(21) Appl. No.: 14/159,799

(22) Filed: Jan. 21, 2014

(65) Prior Publication Data

US 2014/0202446 A1 Jul. 24, 2014

(30) Foreign Application Priority Data

Jan. 23, 2013 (BR) ..... 102013001676

(51) Int. Cl.
*F24C 15/16* (2006.01)

(52) U.S. Cl.
CPC ..... *F24C 15/162* (2013.01)

(58) Field of Classification Search
CPC ..... F24C 15/162; F24C 15/16; Y10T 403/39; Y10T 403/3981; Y10T 403/3993; Y10T 16/554; Y10T 16/5543; Y10T 24/44017; Y10T 24/44026; Y10S 292/69; Y10S 292/15
USPC ..... 403/188, 194, 195, 199
See application file for complete search history.

(56) References Cited

U.S. PATENT DOCUMENTS 3,157,377 A * 11/1964 Orenick ..... F16L 3/127 174/164
3,188,030 A * 6/1965 Fischer ..... F16L 3/10 174/156
3,550,219 A * 12/1970 Van Buren, Jr. ..... F16B 21/075 248/73
4,124,320 A * 11/1978 Rapata ..... F16B 2/22 403/163
4,185,515 A * 1/1980 Webb ..... F16B 21/086 16/2.1
4,356,987 A * 11/1982 Schmid ..... F16G 11/02 24/458
4,637,373 A * 1/1987 Shirai ..... F24C 15/162 126/19 R (Continued)

FOREIGN PATENT DOCUMENTS

GB 476759 A * 12/1937 ..... F24C 15/04
WO 2010022491 4/2010

*Primary Examiner* — Avinash Savani
*Assistant Examiner* — Rabeeul Zuberi
(74) *Attorney, Agent, or Firm* — Pearne & Gordon LLP

(57) ABSTRACT

Traction bearing and rod joint to anchor a sliding shelf set to an oven door, the bearing (1) being made of engineering plastic, stainless steel or another compatible material, and is designed to be installed on the internal glass or surface of the counter door (P) of the stove (F1) by fitting into an orifice. The locking of the bearing (1) in this orifice is held by the provision of a beveled skirt (7) and a collar (6), both applied on the outer surface of the bearing (1). The tensile bearing has a longitudinal slot (2) and a channel (4) that communicate with each other to allow docking and rotation of the end (E) of a rod (H) of the set of shelves (PD) when the door (P) of the oven (F1) is opened or closed.

13 Claims, 2 Drawing Sheets

(56) References Cited

U.S. PATENT DOCUMENTS 5,603,810 A * 2/1997 Michler ..... C10B 25/16
110/173 R
6,161,804 A * 12/2000 Paske ..... F16L 3/12
248/71
6,357,709 B1 * 3/2002 Parduhn ..... F21V 21/116
248/214

* cited by examiner

Section A.A

Section B.B

TRACTION BEARING AND ROD JOINT FROM THE SLIDING SHELF SET

FIELD OF THE INVENTION

The present invention relates to tensile bearing and rod linkage of the set of sliding shelves (PD), particularly installed in home cooking ovens and related ones, where mentioned bearing, it is configured by a single part, made of engineering plastic, stainless steel or another compatible material, designed to be installed on the surface of the counter door of the oven, through fitting into an orifice practiced on this surface, while the locking of the bearing in this orifice is held by the provision of a beveled skirt and a collar, both applied on the outer side of the bearing; said tensile bearing has a longitudinal slot and a channel that communicates with each other and allow docking and rotation of the end of the rod of the set of shelves when the oven door is opened or closed.

BACKGROUND OF THE INVENTION

It is widely known that the sliding shelves applied in the ovens of the stoves in general require some components for the realization of their movement, which act jointly as soon as the oven door is opened or closed.

These components consist of at least one pair of sliding guidance systems fixed on the inner side walls of the oven, at least one shelf bearings or trails that slide on the aforementioned guides, and a pair of rods protruding from the frontal-lateral parts of the shelf (shelves) and said rods being provided with free ends provided and folded in the shape of eyelet or hook capable of coupling into tensile bearings, generally placed on the inner surface of the oven door.

The conventional tensile bearings generally are configured by metal parts and stamped so as to configure a bulkhead to fit the end of the rod, even allowing its rotation on the bulkhead of the bearing, in order to ensure the perfect sliding of the set of shelves at the time of opening or closing of the oven door.

What happens is that these stamped metal parts, as a rule, depend on some manufacturing processes for their correct attachment to the surface of the oven door.

One of the processes to set the tensile bearings (M1) on the counter oven door uses two or more rivets (R) (see FIG. 1 of the state of the art). This model, although widely used by many manufacturers, in addition to affecting the aesthetics of the product, is fragile, since the rivets are elements liable to break, requiring sometimes maintenance on the part of professionals in the area or more skilled people. In addition, usually, the oven door provides the existence of an inner glass (V). If it is desirable that the attachment of tensile bearings (M1) is performed in the inner glass (V), the use of rivets (R) is not a viable solution not only because the manufacturing process is more complex, but also because it compromises the aesthetics of the product.

Another conventional method (also referred to in FIG. 1) provides for the attachment of the tensile bearing (M2) on the oven door or on the inner glass (V) of the door by means of special adhesive (A2). After attaching the bearing (M2), the counter door (P) is forwarded for thermal treatment, where the adhesive (A2) is submitted to cure, in order to ensure its attachment, even if exposed to the high heat of the oven. Examples of technical solutions of the state of the art can be seen in documents PI 0205923, MU 8300847 and PI 9604074.

As noted, these conventional processes, in addition to the tensile bearings themselves, depend on other extra components, such as rivets, adhesives and process steps at various sites, such as curing of the adhesive in thermal treatment chambers, computing considerable increase of the final cost of the product when one considers materials (components), labor and curing time.

Another alternative process, already known, was developed by the holder of this privilege himself and can be viewed in document BR MU 8801927-6. This relates to a rod linkage of the sliding shelf, which can do without the additional stamped part and foresees that, in its lieu, the bearing (M3) is obtained through a stamp on the very counter door (P) of the oven (see FIG. 1), complying with a cut-out (R1) and a protrusion (R2) and, among these, an orifice (O1) that serves as bulkhead of the rod folded end.

Although more efficient than the other one already previously mentioned and the fact that this type of bearing can be applied to glass, it still requires processes of stamping and drilling, steps that help endear the manufacturing process

SUMMARY OF THE INVENTION

To solve the above mentioned drawbacks, the present invention will provide significant advantages in relation to tensile bearings for drive rods of shelves inside the oven of stoves and other ones related, enabling an increase in performance, application both on the inner glass of the door and in the door itself, and presenting a more favorable cost/benefit ratio.

The invention ordinarily comprises a cylindrical component made of engineering plastic or metal, that is, with special characteristics such as, for example, resistance to high temperatures.

This component is press-fitted into the orifice practiced in the inner glass of the oven door or orifice practiced in the oven so as to remain as a stopper. The outer portion of the component has a longitudinal slot which favors the fitting into the orifice of the counter door and a transverse channel in which the folded end of the rod of the set of shelves is housed.

Therefore, after the assembly, said component with its portion of the stopper, act as anchor for rod tensile and, at the same time, allows said end to rotate in the transverse channel, every time the door is opened or closed.

Some substantial advantages can be described, such as:

(i) improvement of the assembly: when assembly on the inner glass is necessary only the drilling of the orifices in the inner glass; when assembled in the counter door of the oven, only the stamping steps of the orifices are necessary; performed during the same step of the other stamps of the counter door, fitting labor is also favored by the longitudinal slot foreseen in the innovated plastic or metal part;

(ii) improves cleaning by the consumer, because it has no sharp corners and it is extremely easy to disassembly and subsequent assembly on the part of any user, and (iii) reduces energy cost, since eliminating the use of adhesives, it also eliminates their curing step, and reduces manufacturing cost, as it would avoid the use of rivets, adhesives and other accessories.

BRIEF DESCRIPTION OF THE FIGURES

The structure of the invention together with further advantages thereof may best be understood by reference to the attached drawings and the following description.

DETAILED DESCRIPTION OF THE INVENTION

Figure 1:
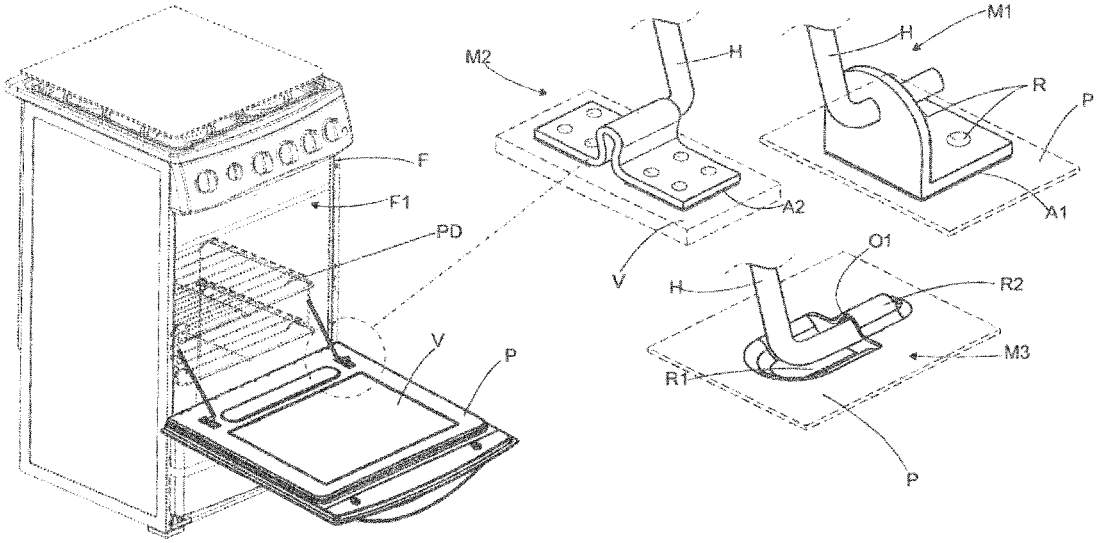
FIG. 1 PRIOR ART
FIG. 1 shows a stove whose the oven door is open, allowing the view the position of the bearings relative to the rods and the set of sliding shelves; in this figure three different tensile bearings belonging to the state of the art and already described previously are shown.
Figure 2:
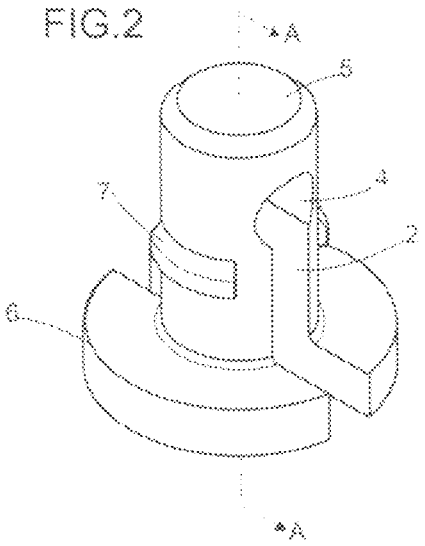
FIG. 2 represents a perspective of the tensile bearing now innovated.
Figure 3:
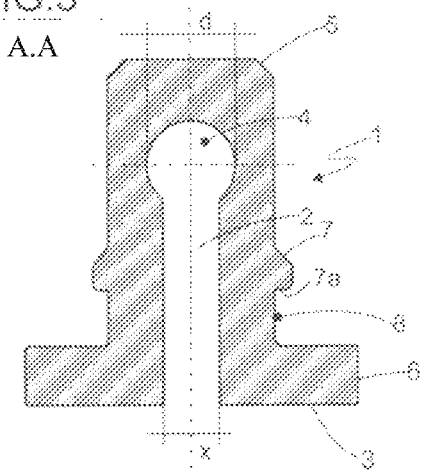
FIG. 3 shows a longitudinal section of FIG. 2.
Figure 4:
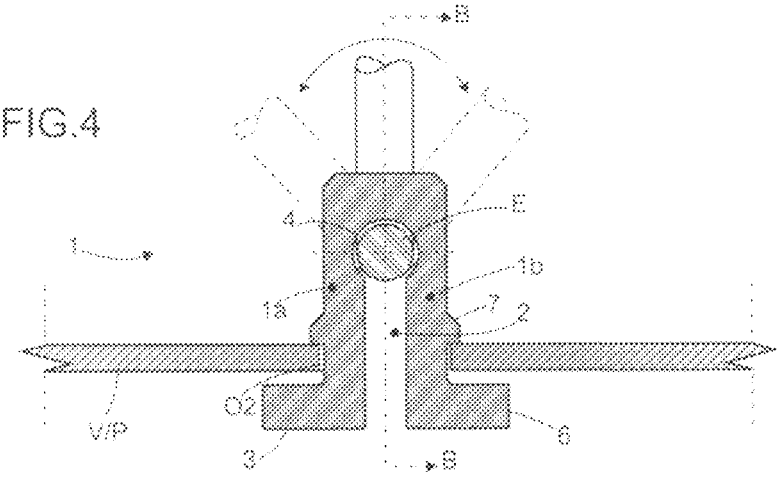
FIG. 4 represents the same longitudinal section of FIG. 2, but the tensile bearing is associated to the counter door of the oven and the rod of the set of shelves.
Figure 5:
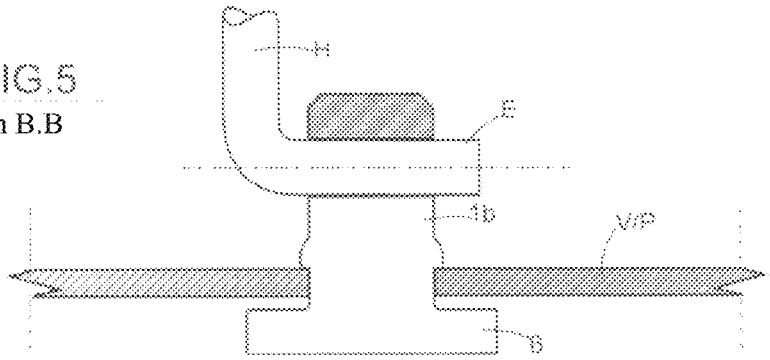
FIG. 5 illustrates another longitudinal section, which represents a rotation of 90° in relation to the view of FIG. 4.

While the present invention may be susceptible to a different modality, it is shown in the drawings and in the following detailed discussion, a preferred modality of the invention with the understanding that the present description must be considered an exemplification of the principles of the invention, without no intention of being limited to what is illustrated and described herein.

The tension bearing (1) belongs to the field of accessories for stoves (F), and other related items, and more particularly, it acts as anchoring element and rotation of the end (E) of the rod (H) of the set of sliding shelves (PD) of the type that is installed in ovens (F1) of stoves (F), including mobile-type, embedded, bench, and related ovens.

According to the present invention, the tensile bearing (1) is preferably made in one piece, obtained preferably in engineering polymer, of the type Teflon®, Zytel®, Fortron®, special silicone and other, that is, with special characteristics, such as, for instance, resistance to high temperatures and may be also made from other materials, such as steel.

This bearing (1) presents itself ordinarily cylindrical and provided with a central longitudinal slot (2) of a thickness (x), which starts at the base (3) of the bearing and extends to reach a transverse channel (4) located next to the head (5) of the bearing, whose channel has a diameter (d), which corresponds to the outer diameter of the end (E) of the rod (H). The longitudinal slot (2) divides the bearing into two portions (1*a*) and (1*b*) flexible between each other, acting with spring effect associated with the memory of the manufacture material of the bearing.

The base (3) has outer peripheral collar (6), and just above it, a beveled skirt (7) is provided, which sets, between the widened base (7*a*) of this and the collar (6), a recessed space (8) for housing of the edge of the orifice (O2), preferably practiced on the inner glass (V) of the oven (F1), at the time of the assembly of the tensile bearing (1) in the stove. In an alternative embodiment, the orifice (O2) can be practiced directly on the counter door (P).

Since the preferred embodiment is the attachment on the inner glass, it is highlighted that the consumer himself can easily remove the tensile bearing described, since cooking ovens are provided in the state of the art, with removable inner glass, thus, facilitating cleaning the oven and components parts, in addition to facilitating, when necessary, the replacement of the part. Thus, to fit the tensile bearing (1) in the hole (O2) of the inner glass or counter door, just bend the portions (1*a*) and (1*b*) in order to bring them together, allowing the bearing to pass through said hole whose inner edge is positioned in the space (8). When releasing the parts (1*a*) and (1*b*), they, due to the flexibility of the material, return to a resting position, turning the orifice (O2) stable between the skirt (7) and the collar (6), consequently allowing that the channel (4) houses the end (E) of the rod (H), allowing its rotation at the time of the opening and closing of the door (P) of the oven (F1).

It is true that when the present invention is put into practice, other related shapes can be made, not being restricted to the examples mentioned above. Changes relative to certain details of construction, shape and material can be practiced without implying moving away from the fundamental principles that are clearly substantiated on the set of claims, being thus understood that the terminology employed had the purpose not to limit it.

What is claimed is:

1. A traction bearing and rod joint to anchor a sliding shelf set to an oven door to act as an anchoring element for end rotation of a rod from the sliding shelf set;

wherein the traction bearing is cylindrical and provided with central longitudinal slot, with thickness, beginning at a base of the bearing and extending until reaching a transversal channel, the transversal channel passing through a head of the bearing and having a diameter substantially equivalent to an external diameter of the end of the rod;

wherein the longitudinal slot divides the bearing in two portions and flexible between them;

wherein the base has a collar and a beveled skirt above the collar that is tapered such that a diameter at an upper portion of the beveled skirt is smaller than a diameter at a lower portion of the beveled skirt, the lower portion being located farther from the transversal channel than the upper portion;

wherein a recessed space is located between the lower portion of the beveled skirt and the collar for housing an orifice edge of an orifice of the oven door;

wherein the beveled skirt comprises a frustoconical surface that extends at least partially about a central axis of the traction bearing; and wherein the traction bearing is configured to be anchored to the oven door by inserting the head and the beveled skirt of traction bearing through the orifice; and wherein a diameter of the collar is substantially greater than the diameter at the lower portion of the beveled skirt.

2. The traction bearing according to claim 1 wherein the orifice (2) is made in internal glass (V) of the oven door of the oven (F1).

3. The traction bearing according to claim 1 wherein the orifice (2) is made in a counter-door (P) of the oven (F1).

4. The traction bearing according to claim 1 wherein since the longitudinal slot (2) is composed by two portions (1*a*) and (1*b*) flexible between them, the traction bearing (1) acts with a spring effect associated with the memory of the material of the bearing's manufacture.

5. The traction bearing according to claim 1 wherein the traction bearing (1) is made of engineering polymer.

6. The traction bearing according to claim 1 wherein traction bearing (1) is made of steel.

7. The traction bearing according to claim 1 wherein the end rotation (E) of the rod (H) occurs in the channel (4) of the traction bearing (1).

8. The traction bearing according to claim 1 wherein the traction bearing (1) is made in single part.

9. The traction bearing according to claim 1, wherein a cross-section of the transversal channel comprises a perimeter that is closed except where the longitudinal slot intersects the channel.

10. The traction bearing according to claim 1, wherein the channel defines a closed end of the slot.

11. The traction bearing according to claim 1, wherein the channel is spaced from the base.

12. The traction bearing according to claim 1, wherein the head (5) of the traction bearing (1) has a substantially cylindrical outer surface that is coaxial with the beveled skirt (7).

13. The traction bearing according to claim 1, wherein the collar (6) of the traction bearing (1) has a substantially cylindrical outer surface.

* * * * *